US006781322B2

(12) United States Patent
Onozawa et al.

(10) Patent No.: US 6,781,322 B2
(45) Date of Patent: Aug. 24, 2004

(54) CAPACITIVE LOAD DRIVE CIRCUIT AND PLASMA DISPLAY APPARATUS

(75) Inventors: Makoto Onozawa, Kawasaki (JP); Eiji Ito, Kawasaki (JP); Ken Kumakura, Kawasaki (JP); Hideaki Ohki, Yokohama (JP); Masaki Kamada, Yokohama (JP); Kazuyoshi Yamada, Yokohama (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/347,693

(22) Filed: Jan. 22, 2003

(65) Prior Publication Data

US 2003/0214244 A1 Nov. 20, 2003

(30) Foreign Application Priority Data

May 16, 2002 (JP) ..... 2002-141845

(51) Int. Cl.[7] ..... H05B 37/02

(52) U.S. Cl. ..... 315/169.3; 315/169.1; 345/60

(58) Field of Search ..... 315/169.1, 169.3, 315/169.4, 224, 226; 345/60, 61, 62, 76, 212, 108

(56) References Cited

U.S. PATENT DOCUMENTS

| | | | | | |
|---|---|---|---|---|---|
| 4,070,663 | A | | 1/1978 | Kanatani et al. | 345/60 |
| 4,316,123 | A | * | 2/1982 | Kleen et al. | 315/169.4 |
| 4,866,349 | A | * | 9/1989 | Weber et al. | 315/169.4 |
| 5,081,400 | A | | 1/1992 | Weber et al. | 315/169.4 |
| 5,786,794 | A | | 7/1998 | Kishi et al. | 345/60 |
| 5,943,030 | A | * | 8/1999 | Minamibayashi | 345/60 |
| 6,124,677 | A | * | 9/2000 | Lardeau et al. | 315/169.4 |
| 6,380,690 | B1 | * | 4/2002 | Inada | 315/169.3 |

FOREIGN PATENT DOCUMENTS

| | | |
|---|---|---|
| EP | 1 030 286 A2 | 8/2000 |
| EP | 1 065 650 A2 | 1/2001 |
| EP | 1 139 323 A2 | 10/2001 |
| JP | 7-160219 | 6/1995 |
| JP | 9-68946 | 3/1997 |
| JP | 2000-92131 | 3/2000 |
| JP | 2000-194316 | 7/2000 |
| JP | P3201603 | 6/2001 |
| JP | 2001-282181 | 10/2001 |
| JP | 2002-351388 | 12/2002 |

* cited by examiner

*Primary Examiner*—James Vannucci
*Assistant Examiner*—Jimmy T. Vu
(74) *Attorney, Agent, or Firm*—Staas & Halsey LLP

(57) ABSTRACT

A capacitive load circuit and a plasma display apparatus using such a circuit, being able to use a sustain transistor having a voltage rating in accordance with a sustain voltage even when a voltage larger than the sustain voltage is applied to a sustain electrode, have been disclosed, wherein a switch whose one end is connected to a capacitive load is comprised and when a third voltage, whose voltage difference from a second voltage is larger than the voltage difference between a first voltage and the second voltage, is applied to the capacitive load, a fourth voltage is selectively applied to the other end of the switch.

15 Claims, 8 Drawing Sheets

CAPACITIVE LOAD DRIVE CIRCUIT AND PLASMA DISPLAY APPARATUS

BACKGROUND OF THE INVENTION

The present invention relates to a plasma display apparatus. More particularly, the present invention relates to an improvement of a drive circuit that applies a voltage pulse to an electrode at which a sustain discharge is caused to occur.

The plasma display apparatus has been put to practical use as a flat display and is a thin display with high luminance. FIG. 1 is a diagram that shows the general structure of a conventional three-electrode AC-driven plasma display apparatus. As shown schematically, the plasma display apparatus comprises a plasma display panel (PDP) 1 composed of two substrates, between which a discharge gas is sealed, each substrate having plural X electrodes (X1, X2, X3, . . . , Xn) and Y electrodes (Y1, Y2, Y3, . . . , Yn) arranged adjacently by turns, plural address electrodes (A1, A2, A3, . . . , Am) arranged in the direction perpendicular thereto, and phosphors arranged at crossings, an address driver 2 that applies an address pulse to the address electrode, an X common driver 3 that applies a sustain discharge pulse to the X electrode, a scan driver 4 that applies a scan pulse sequentially to the Y electrode, a Y common driver 5 that supplies a sustain discharge pulse to be applied to the Y electrode to the scan driver 4, and a control circuit 6 that controls each section, and the control circuit 6 further comprises a display data control section 7 that includes a frame memory and a drive control circuit 8 composed of a scan driver control section 9 and a common driver control section 10. The X electrode is also referred to as the sustain electrode and the Y electrode is also referred to as the scan electrode. As the plasma display apparatus is widely known, a more detailed description of the entire apparatus is not given here and only the X common driver 3 and the Y common driver 5 that relate to the present invention are further described. The X common driver, the scan driver and the Y common driver of the plasma display apparatus have been disclosed, for example, in Japanese Patent No. 3201603, Japanese Unexamined Patent Publication (Kokai) No. 9-68946 and Japanese Unexamined Patent Publication (Kokai) No. 2000-194316.

FIG. 2 is a diagram that shows an example of the structure of the X common driver, the scan driver and the Y common driver, which have been disclosed as described above. The plural X electrodes are connected commonly and driven by the X common driver 3. The X common driver 3 comprises output devices (transistors) Q8, Q9, Q10 and Q11, which are provided between the common X electrode terminal and a voltage source +Vs1, between that and −Vs2, between that and +Vx, and between that and the ground (GND), respectively. By turning on any one of the transistors, the corresponding voltage is supplied to the common X electrode terminal.

The scan driver 4 is composed of individual drivers provided for each Y electrode and each individual driver comprises transistors Q1 and Q2, and diodes D1 and D2 provided in parallel thereto, respectively. One end of each transistor Q1 and Q2, and of diodes D1 and D2 of each individual driver, is connected to each Y electrode and each other end is connected commonly to the Y common driver 5. The Y common driver 5 comprises transistors Q3, Q4, Q5, Q6 and Q7, which are provided between the lines from the scan driver 4 and the voltage sources +Vs1, −Vs2, +Vw, the ground (GND) and −Vy, respectively, and the transistors Q3, Q5 and Q7 are connected to the transistor Q1 and the diode D1, and the transistors Q4 and Q6, to the transistor Q2 and the diode D2.

FIG. 3 is a diagram that shows drive waveforms of a plasma display apparatus. The operations in the circuit shown in FIG. 2 are described with reference to FIG. 3. In a reset period, Q5 and Q11 are turned on while the other transistors are being kept off, and +Vw (a third voltage) is applied to the Y electrode and 0V is applied to the X electrode to generate an entire write/erasure pulse that brings the display cells in the panel 1 into a uniform state. At this time, the voltage +Vw is applied to the Y electrode via Q5 and D1. In an address period, Q6, Q7 and Q10 are turned on while the other transistors are being kept off, and +Vx is applied to the X electrode, the voltage GND, to the terminal of Q2, and −Vy (−Vs2 in FIG. 3) is applied to the terminal of Q1. In this state, a scan pulse that turns Q1 on and turns Q2 off is applied sequentially to the individual drivers. At this time, in individual drivers to which a scan pulse is not applied, Q1 is turned off and Q2 is turned on, therefore, −Vy is applied to the Y electrode, to which the scan pulse is applied, via Q1, GND is applied to the other Y electrodes via Q2, and an address discharge is caused to occur between the address electrode to which a positive data voltage is applied and the Y electrode to which the scan pulse is applied. In this way, each cell in the panel is put into a state according to the display data.

In a sustain discharge period, while Q1, Q2, Q5 to Q7, Q10 and Q11 are being kept off, Q3 and Q9, and Q4 and Q8 are alternately turned on. These transistors are called the sustain transistors, wherein Q3 and Q8 that are connected to a high potential side power source are called the high-side switches, and Q4 and Q9 that are connected to a low potential side power source are called the low-side switches, here. In this way, +Vs1 (a first voltage) and −Vs2 (a second voltage) are alternately applied to the Y electrode and the X electrode and a sustain discharge is caused to occur in the cell in which an address discharge has been caused to occur in the address period and the display is performed. At this time, if Q3 is turned on, +Vs1 is applied to the Y electrode via D1, and if Q4 is turned on, −Vs2 is applied to the Y electrode via D2. In other words, the voltage Vs1+Vs2 is alternately applied to the X electrode and the Y electrode, with a reversed polarity, in the sustain discharge period. This voltage is called the sustain voltage here.

The example described above is only one of various examples, and there are various modifications as to which kind of voltage is applied in the reset period, the address period and the sustain discharge period, and there are also various modifications of the scan driver 4, the Y common driver 5 and the X common driver 6. Particularly in the drive circuit described above, +Vs1 and −Vs2 are applied alternately to the Y electrode and the X electrode to apply the sustain voltage of Vs1+Vs2=Vs, but there is another method in which Vs and GND are applied alternately and it is widely used.

In the general plasma display apparatus, the voltage Vs is set to a value between 150V and 200V, and the drive circuit is made up of transistors of large voltage rating (breakdown voltage). Contrary to this, in the driving method disclosed in such as Japanese Patent No. 3201603, Japanese Unexamined Patent Publication (Kokai) No. 9-68946 and Japanese Unexamined Patent Publication (Kokai) No. 2000-194316, the positive and negative sustain voltages (+Vs/2 and −Vs/2) are applied alternately to the X electrode and the Y electrode, as described above. This has an advantage in that it will be possible to reduce the breakdown voltage of the smoothing capacitor of the power source that supplies the sustain voltage.

U.S. Pat. No. 4,070,633 has disclosed a control system in which an inductance element that constitutes a resonance circuit together with a capacitor in a display unit is provided in order to reduce the power consumption of a capacitive display unit, such as an EL (Electro-Luminescence) display panel. Moreover, U.S. Pat. Nos. 4,866,349 and 5,081,400 have disclosed a sustain (discharge) driver and an address driver for a PDP panel having a power recovery circuit composed of inductance elements. On the other hand, Japanese Unexamined Patent Publication (Kokai) No. 7-160219 has disclosed a structure for a three-electrode display unit, in which two inductance elements, that is, an inductance element that forms a recovery path to recover the power being applied to the Y electrode when the Y electrode is switched from a high potential to a low potential, and another inductance element that forms an application path to apply the stored power when the Y electrode is switched from the low potential to the high potential, are provided. Moreover, the present applicants have disclosed a structure in which a phase adjusting circuit is provided, which adjusts the phase of a signal to be applied to the gates of transistors that make up the switches of a Y common driver and an X common driver in Japanese Patent Application P No. 2001-152744, and a structure in which the switches of a Y common driver and an X common driver are made up of transistors having low breakdown voltages in Japanese Patent Application P No. 2002-086225.

FIG. 4 is a diagram that shows a more concrete example of the structure of a Y electrode drive circuit in which two systems of power recovery paths are provided and sustain voltages Vs and −Vs are applied alternately to X electrodes and Y electrodes. The scan voltage is Vs. The circuit shown in FIG. 4 is a concrete circuit and corresponds to a certain extent to the basic structure shown in FIG. 2, but is not exactly the same. CL represents a display capacitor formed by the X electrode and the Y electrode. The scan driver is the same as that shown in FIG. 2. CU corresponds to the transistor Q3 in FIG. 2, one end of which is connected to the transistor Q1 and the other end of which is connected via a diode D5 to a terminal to which the first voltage Vs is supplied and at the same time to a reset circuit 15. CD corresponds to the transistor Q4 in FIG. 2, one end of which is connected to the transistor Q2 and the other end of which is connected to a terminal to which the second voltage −Vs is supplied. QS corresponds to the transistor Q7 in FIG. 2, one end of which is connected to the transistor Q1. QY corresponds to the transistor Q6 in FIG. 2, one end of which is connected to the transistor Q2. To the gates of CU and CD, sustain signals CUG and CDG, the phases of which have been adjusted in phase adjusting circuits 11 and 12, are applied, respectively. In the circuit in FIG. 4, Vw is generated by raising the voltage at the connection point of the diode D5 and CU from Vs to Vs+Vw0 in the reset circuit 15. Therefore, there is no transistor that corresponds to Q5 in FIG. 2.

The reset circuit 15 comprises transistors QW and QW1 serially connected between the voltage Vw0 and the ground, a voltage-raising capacitor CS connected between the connection point of the transistors QW and QW1 and the terminal of CU, and a ramp signal circuit 16 that transforms a reset signal RG into a waveform that changes gradually as shown in FIG. 3. A signal RY turns QW1 into the on-state (conductive state), QW into the off-state (non-conductive state), and charges CS to the voltage Vs. Next, when QW1 is turned off and QW is turned on, the voltage at the one end of CS changes from ground to Vw0, therefore, the voltage at the other end of CS changes to Vs+Vw0=Vw, and a reset voltage Vw (third voltage) is supplied from the reset circuit.

The power recovery circuit comprises a capacitor C1, inductance elements L1 and L2, diodes D3 and D4, and transistors LU and LD. One end of C1 is connected to the ground and the other is connected to Q1 via LU, D3 and L1, and at the same time is connected to Q2 via LD, D4 and L2. Signals LUG and LDG to be applied to the gates of the transistors LU and LD are also phase-adjusted in phase adjusting circuits 13 and 14 and then applied to the gates. As the power recovery circuit has been disclosed in Japanese Unexamined Patent Publication (Kokai) No. 7-160219, a detailed description is not given here.

Although only the Y electrode drive circuit is described above, a power recovery circuit is also provided in the X electrode drive circuit. Moreover when a reset voltage is applied to the X electrode, a reset circuit is provided in the X electrode drive circuit.

The scan pulse must be applied sequentially to each Y electrode and, therefore, Q1 and Q2, that relate to the application of the scan pulse, are required to be capable of high-speed operations. Moreover, as the number of times a sustain discharge is caused to occur affects the display luminance and as many sustain discharges as possible must be caused to occur in a fixed period, the sustain transistors Q3, Q4, Q8, and Q9 shown in FIG. 2 (CU and CD in FIG. 4), which relate to the application of the sustain discharge pulse, are also required to be capable of high-speed operations. The transistors (LU and LD in FIG. 4) that make up the power recovery circuit must also be capable of high-speed operations. On the other hand, in the plasma display apparatus, it is necessary to apply a high voltage to each electrode in order to cause a discharge to occur, therefore, the transistors are required to have a high breakdown voltage. A transistor that has a high breakdown voltage but has a relatively low operating speed, or a transistor that has a high operating speed but has a relatively low breakdown voltage, can be manufactured at a low cost, but a transistor that has not only a high breakdown voltage but also a high operating speed is costly, and, simultaneously, the resistance in the on state is high and the power loss is large.

Among the transistors in FIG. 2, the operating speed of Q6, Q7, Q10 and Q11 (QW, QW1, QS and QY in FIG. 4) can be relatively low because they do not directly relate to the application of the scan pulse and the sustain discharge pulse, which requires a high-speed operation. Although a high-speed operation is required for Q1 and Q2, their breakdown voltages can be relatively small, because D1 and D2 are provided in parallel thereto, the voltages to be applied are −Vy (−Vs in FIG. 4) and GND, and the difference in voltage therebetween is relatively small.

Contrary to this, the sustain transistors Q3, Q4, Q8, and Q9 (CU and CD in FIG. 4) must be capable of high-speed operations and a high voltage is applied thereto as well. The transistors LU and LD must also be capable of high-speed operations and a high voltage is applied as well. In the power recovery circuit, when a counter electromotive force near Vs is generated in the inductance elements L1 and L2, a voltage near Vs1+Vs2 is also applied to the transistors LU and LD.

Among the applied voltages in the circuit in FIG. 2, the largest one is the reset voltage +Vw and the smallest one is −Vs2 (−Vs in FIG. 4). When Q5 is turned on and the reset voltage +Vw is applied, therefore, the voltage Vw+Vs2 is applied to the sustain transistor Q4 (CD in FIG. 4), as a result. Normally, −Vy is larger than −Vs2 (the absolute value is smaller) and +Vx is equal to or smaller than +Vs1. Due to this, the maximum voltage to be applied to other sustain transistors Q3, Q8 and Q9 is Vs1+Vs2, which is smaller than the voltage Vw+Vs2 to be applied to Q4. Similarly, a voltage near Vw+Vs is applied also to the transistor LD in the power recovery circuit, as a result. However, as the diode 3 is provided, such a large voltage is not applied to the transistor LU. Therefore, even when no inductance element is used, a voltage larger than that to be applied to LU is applied to the transistor LD.

There are various modification examples of the voltage to be supplied from the drive circuit of the plasma display apparatus and, therefore, the maximum voltage to be applied to each sustain transistor differs from another accordingly. In general, when a voltage larger than the sustain voltage on the high potential side is applied, the maximum voltage to be applied to the sustain transistors that make up the low-side switch is larger than the sustain voltage, and when a voltage smaller than the sustain voltage on the low potential side is applied, the maximum voltage to be applied to the sustain transistors that make up the high-side switch is larger than the sustain voltage.

When such a switch, as described above, to which a large voltage is applied and which must be capable of high-speed operations, is constructed, elements having a large breakdown voltage such as power MOSFETs and IGBTs are generally used. However, the elements having a large breakdown voltage have a high resistance in the on-state and the power loss is large. Therefore, a problem occurs that power consumption is increased and, simultaneously, the amount of the heat generated in a transistor is large and its temperature becomes high. To solve this problem, it is proposed to reduce the amount of generated heat by connecting plural transistors in parallel, but another problem occurs in this case that the cost for parts is increased as the number of the parts is increased.

SUMMARY OF THE INVENTION

The present invention has been developed in order to solve these problems and its objective is to realize a capacitive load circuit and a plasma display apparatus using it, in which a sustain output element (transistor) having a voltage rating according to a sustain voltage can be used even when a voltage larger than the sustain voltage is applied to a sustain electrode (X electrode and Y electrode) in the reset period and the address period.

FIG. 5 is a diagram that illustrates the principle of the capacitive load circuit of the present invention. In FIG. 5, CL is a capacitive load driven in this circuit, and it corresponds to the display capacitor in a plasma display panel. One end of CL is grounded and the other is connected to this drive circuit. V0 is the voltage applied to the other end. The other end of CL is connected to a switch CUSW and, at the same time, is connected to a switch CDSW. The switch CUSW is connected to a first voltage source that supplies a first voltage Vs1 via a diode 5 and at the same time is connected to a third voltage source that supplies a third voltage Vw via a switch RSW. The switch CDSW is connected to a second voltage source that supplies a second voltage Vs2 via a switch BSW and at the same time is connected to a voltage source that supplies a voltage VA via a switch ASW.

The other end of CL is further connected to a switch LSW via an inductance element L. The switch LSW is connected to a voltage source that supplies a voltage VP via a switch PSW and, at the same time, is connected to a voltage source that supplies a voltage VQ via a switch QSW. Signals CUG, CDG, RG, BG, AG, LG, PG and QG are the control signals for the switches CUSW, CDSW, RSW, BSW, ASW, LSW, PSW and GSW. These switches are turned into an active state, that is, the on-state in which the switches become conductive by a "High (H)" signal.

The switches CUSW and CDSW correspond to the transistors CU and CD in FIG. 4, the switch LSW corresponds to a bidirectional switch, which is equivalent to a switch composed of the transistors LU and LD operating as a one-directional switches, and VP changes according to the situation.

FIG. 6 is a diagram that shows the control signals of the voltage V0 and each switch when the voltage Vs1 and Vs2 are applied alternately and the voltage Vw is applied to CL in the circuit shown in FIG. 5. As shown schematically, when the voltages Vs1 and Vs2 are applied alternately to CL, in a state in which RSW, ASW and QSW are turned into a non-conductive state (off-state) and BSW and PSW are turned on, CUSW and CDSW are turned on alternately and LSW is turned on during the period of switching. To be concrete, in a state in which CDSW is turned on and Vs2 is being applied to CL (that is, a state in which V0 is Vs2), CDSW is turned off and LSW is turned on to apply the stored voltage VP (a high voltage in this case) to CL, and CUSW is turned on when V0 reaches a middle point and V0 is changed to Vs1. LSW is turned off after CUSW turns on. Next, CUSW is turned off, LSW is turned on, and the charges retained in CL are recovered and stored. When V0 drops to a middle point, CDSW is turned on and V0 is changed to Vs2. These actions are the same as conventional ones.

When the voltage VW is applied to CL, in a state in which CDSW, BSW, LSW and PSW are turned off and CUSW, ASW and QSW are turned on, RSW is turned on alternately. Due to this, Vw is applied to CL via CUSW and RSW. At this time, VA is applied to one end of CDSW and VQ is applied to one end of LSW. As Vw−VA and Vw−VQ are smaller than the sustain voltage Vs1−Vs2, a voltage smaller than the voltage to be applied during sustaining is applied to CDSW and LSW. Therefore, the breakdown voltage of CDSW and LSW, for which high-speed operations are required, can be set in accordance with the voltage to be applied during sustaining and can be made up of elements having a comparatively low breakdown voltage.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

Figure 1:
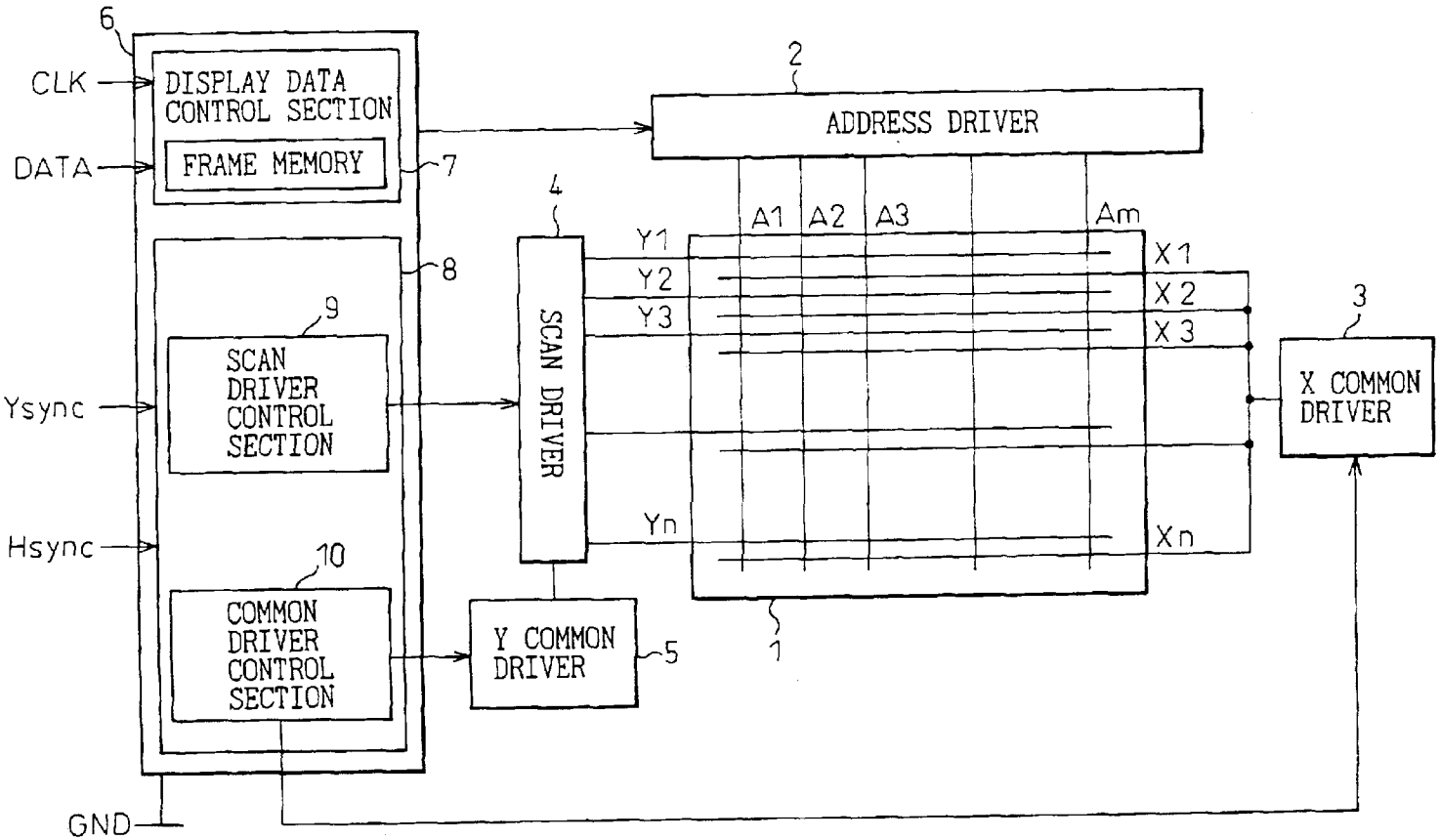
FIG. 1 is a diagram showing the general structure of a plasma display apparatus.
Figure 2:
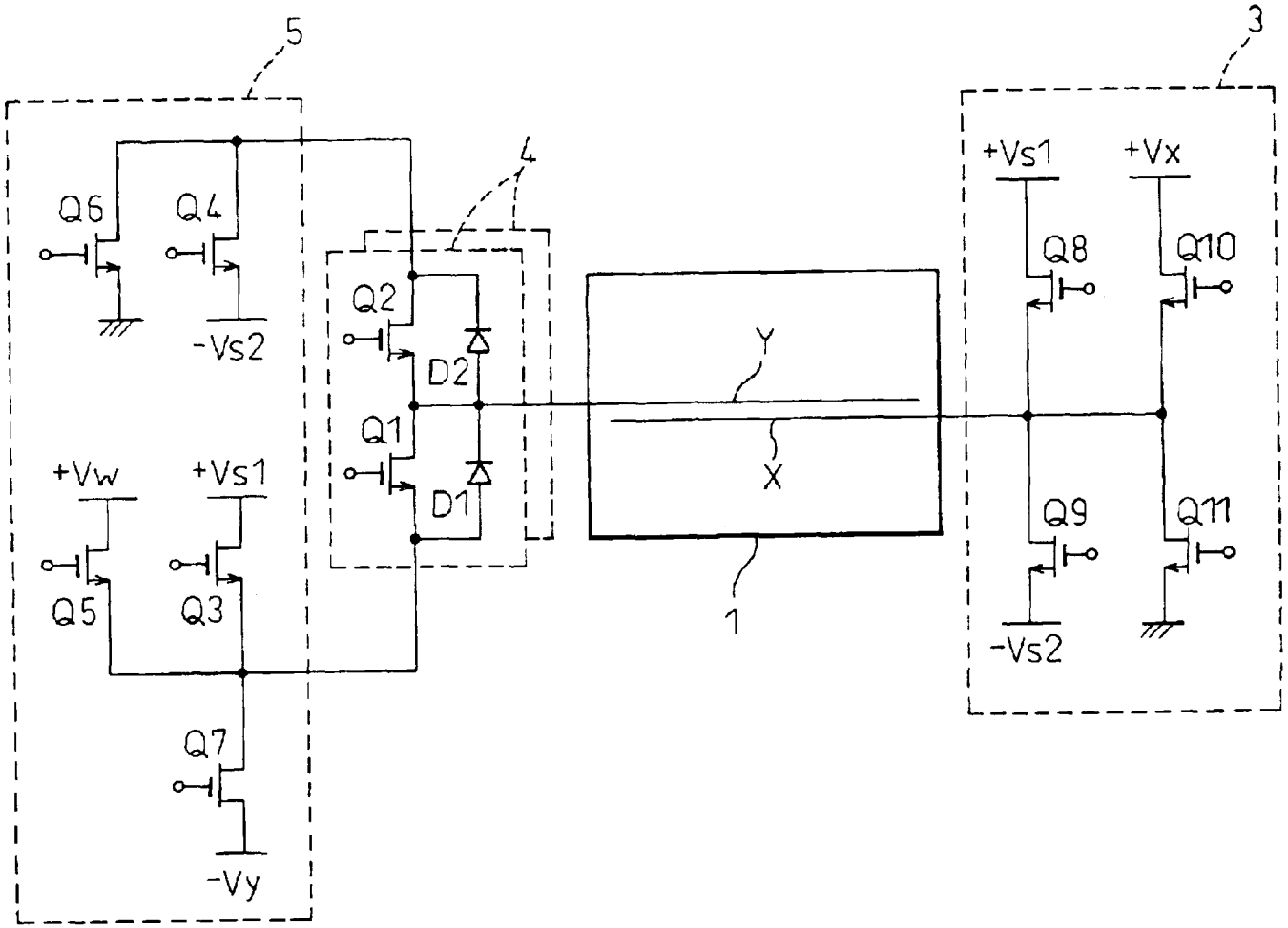
FIG. 2 is a diagram showing an example of conventional X electrode and Y electrode drive circuits.
Figure 3:
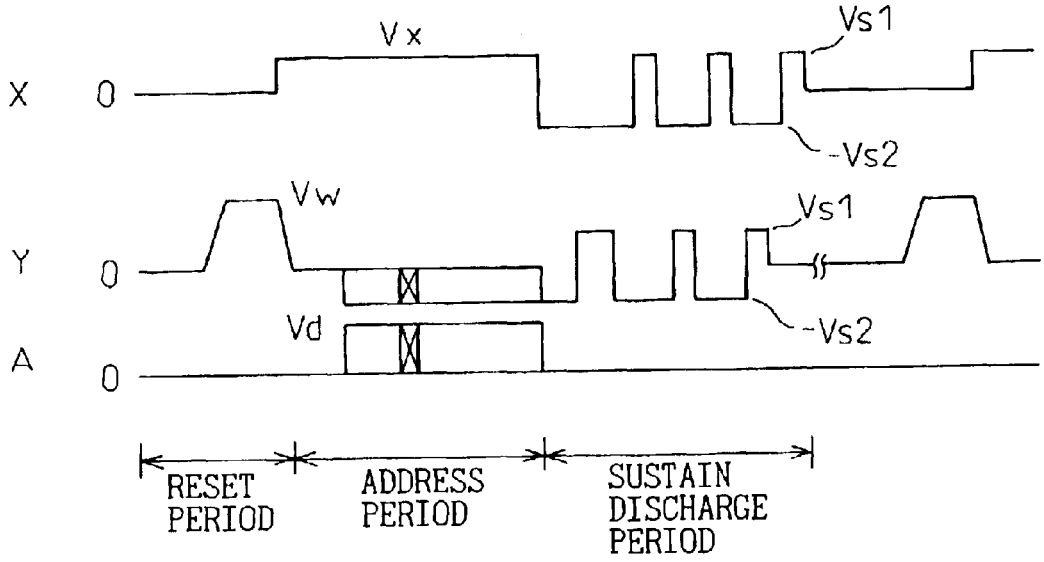
FIG. 3 is a diagram showing waveforms of voltages applied to each electrode of the plasma display apparatus.

The plasma display apparatus in the embodiments of the present invention has such a structure as shown in FIG. 1, wherein a reset voltage larger than a sustain voltage is applied to a Y electrode. Therefore, the structure of an X electrode drive circuit (X common driver) has a structure similar to the circuit described above or disclosed in Japanese Patent Application No. P2001-152744 and Japanese Patent Application No. P2002-086225.

Figure 4:
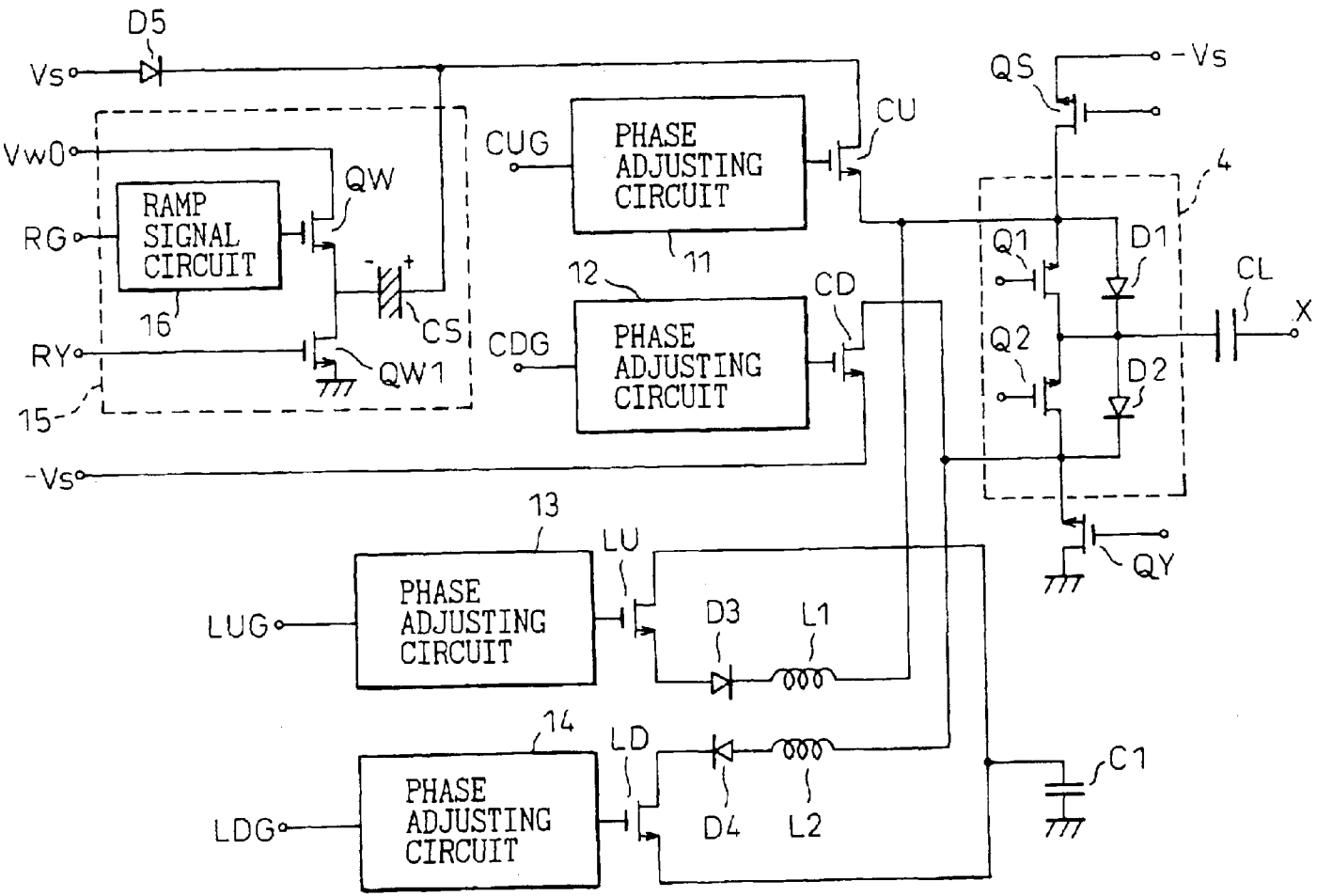
FIG. 4 is a diagram showing an example of a structure of the Y electrode drive circuit of the plasma display apparatus.
Figure 5:
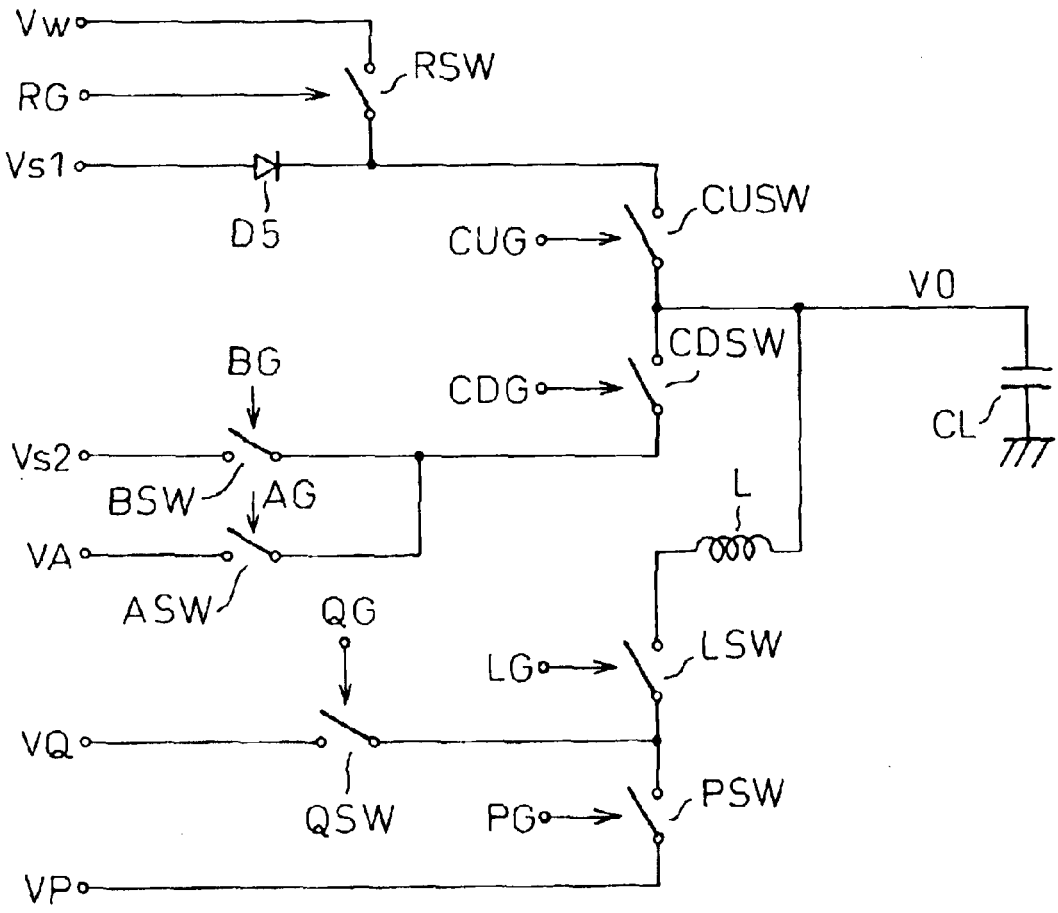
FIG. 5 is a diagram illustrating the principle of the present invention.
Figure 6:
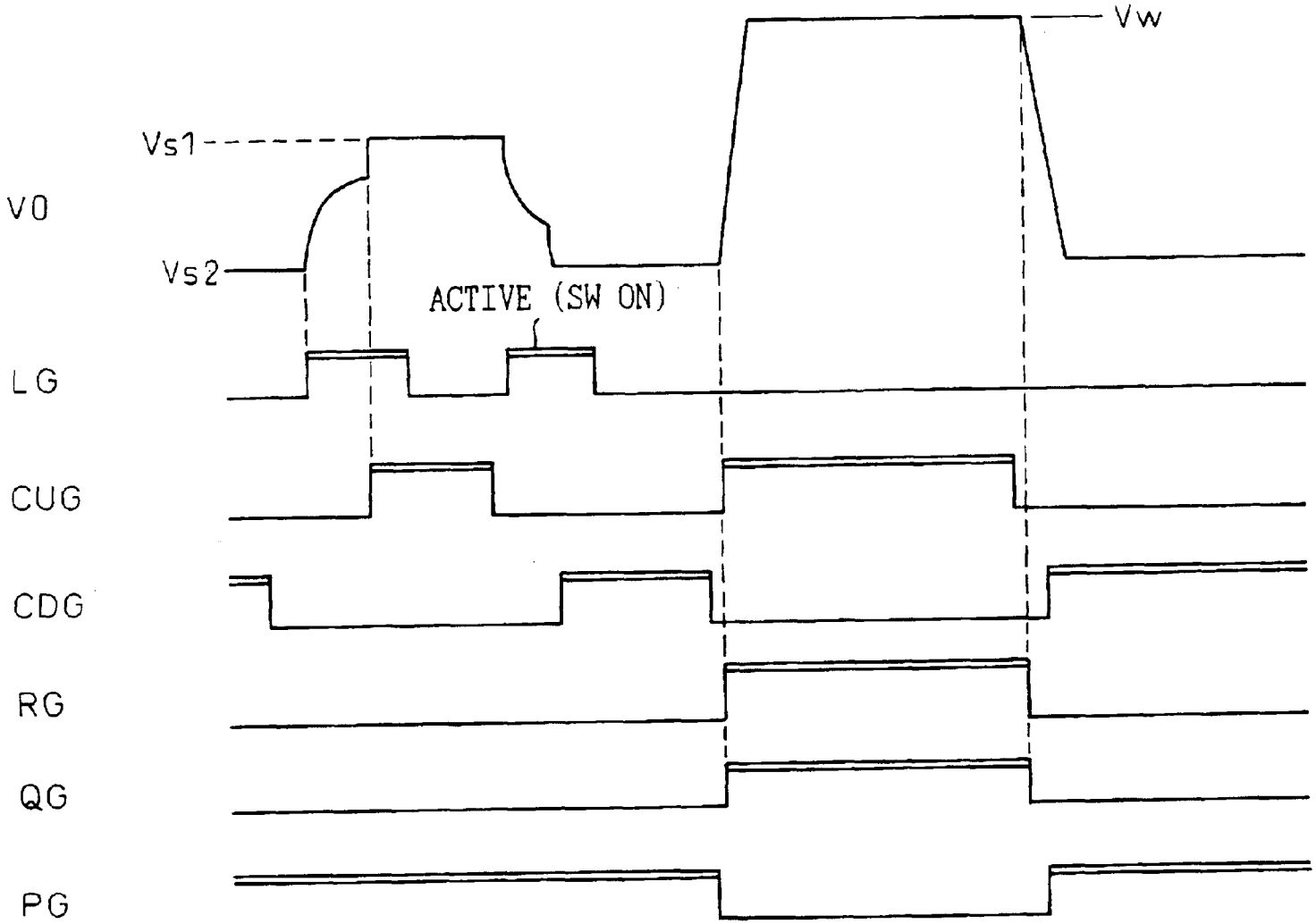
FIG. 6 is a diagram showing applied voltages and operations of switches in the figure illustrating the principle.
Figure 7:
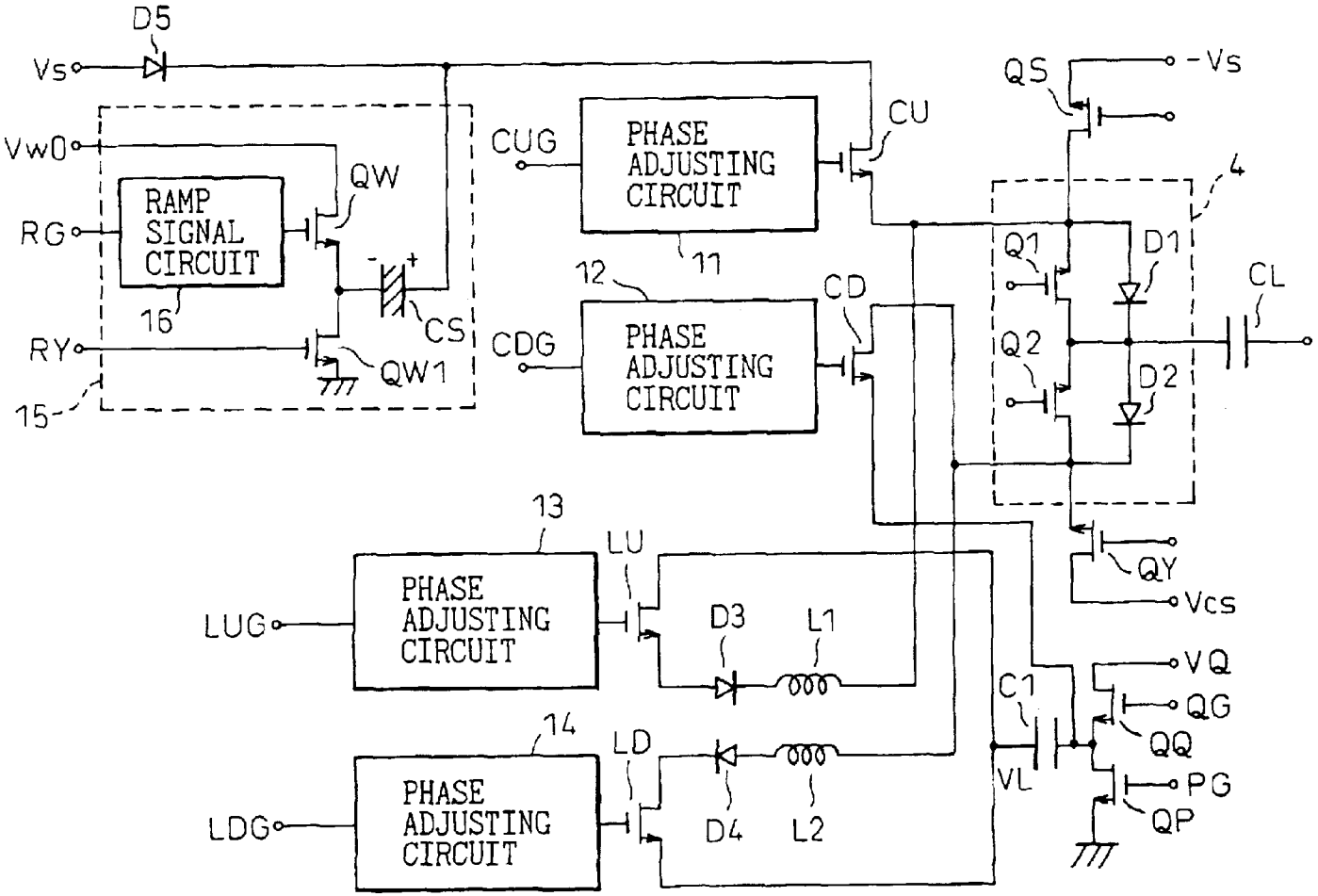
FIG. 7 is a diagram showing the structure of a Y electrode drive circuit in a first embodiment of the present invention.

FIG. 7 is a diagram that shows the structure of a Y electrode drive circuit in the first embodiment of the present invention. As is obvious from a comparison with FIG. 4, the circuit differs from that in FIG. 4 in that one end of a transistor CD and one end of a capacitor C1 are connected to the connection point of transistors QQ and QP being connected serially between a voltage VQ and the ground. Moreover, the voltage to be applied to the Y electrode during the sustain discharge period changes between Vs and the ground voltage. The switches BSW and PSW in FIG. 5 correspond to the switch QP in FIG. 7 and the switches ASW and QSW in FIG. 5 correspond to the switch QQ in FIG. 7.

During the sustain discharge period, QQ is turned off, QP is turned on, the voltage of one end of the capacitor C1 is set to the ground level, and the voltage VL of the other end is set to a value close to a valve halfway between the sustain voltage Vs and the ground level. Then, in a state in which transistors QS, QY and QW are turned off, QW1 is turned on, Vs is applied to CU, CD is grounded, and CU and CD, and LU and LD are turned on alternately while CD is being connected to the ground. The action in this case is the same as the conventional one.

During the reset period, QQ is turned on, QP is turned off, and the voltage of one end of the capacitor C1 is raised to VQ. As a result, the voltage VL is also raised. Then, in a state in which the transistors CD, QS, QY, LU and LD are turned off and CU is turned on, QW1 in the reset circuit 15 is turned off and QW is turned on to generate a reset voltage Vw at one end of a voltage-raising capacitor CS, which is then applied to CL via CU. At this time, as VQ that is larger than the ground level is applied to one end of CD, the voltage to be applied across CD is Vw−VQ, which is smaller than Vw. Similarly, as a voltage larger than the ground level is applied to one end of LD, the voltage to be applied across LD is also smaller than Vw. It is possible to make the voltage, which is applied across CD and LD during the reset period, smaller than the sustain voltage Vs by properly setting the voltage VQ, and it is unlikely that a voltage larger than the sustain voltage Vs is applied across CD and LD. Therefore, it is possible to specify the breakdown voltage of the transistors CD and LD according to the sustain voltage Vs, which is smaller than the reset voltage Vw and, hence, a structure composed of elements having a comparatively low breakdown voltage can be realized.

Figure 8:
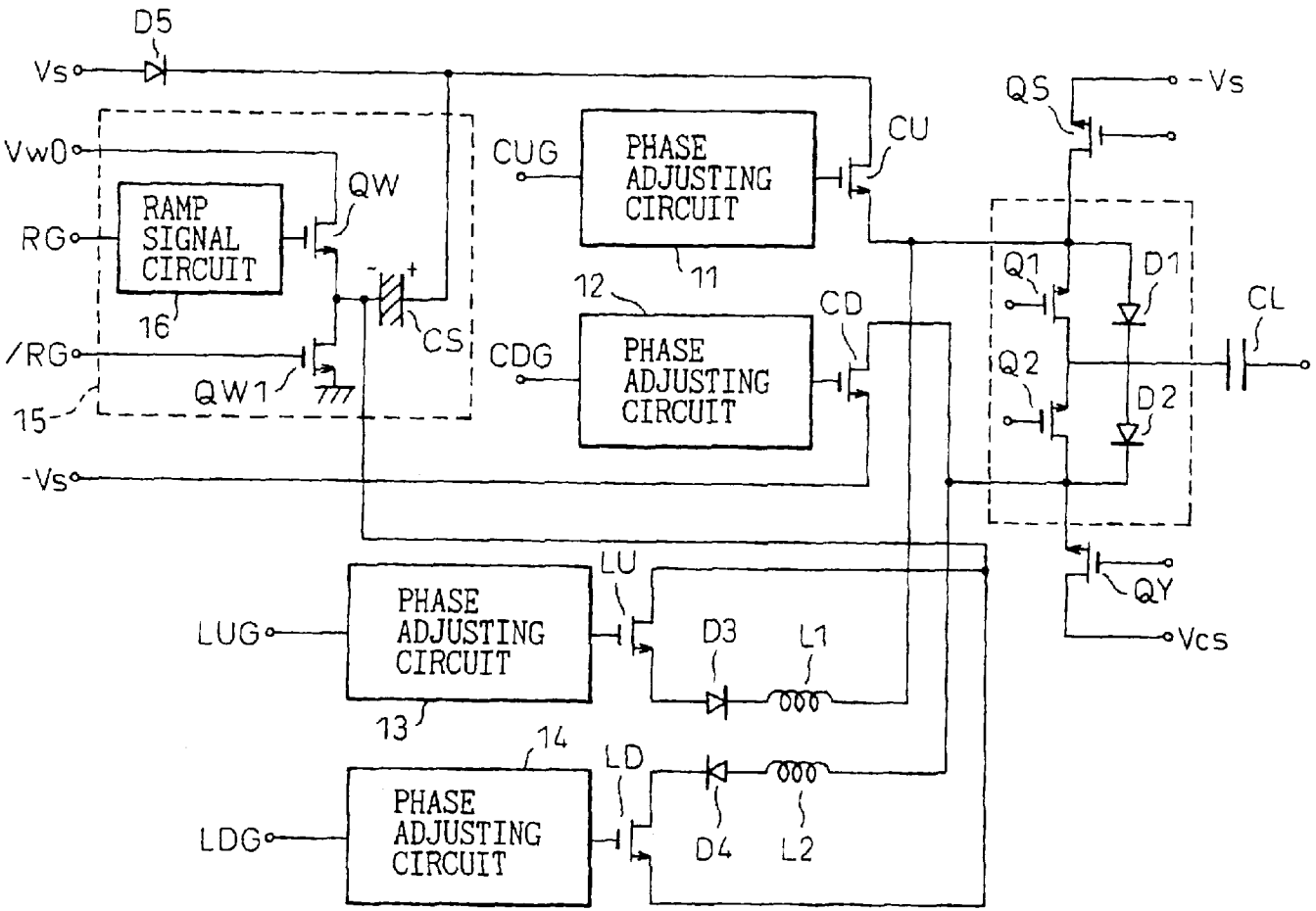
FIG. 8 is a diagram showing the structure of a Y electrode drive circuit in a second embodiment of the present invention.

FIG. 8 is a diagram that shows the structure of the Y electrode drive circuit in the second embodiment of the present invention. As is obvious from a comparison with FIG. 4, the circuit differs from that in FIG. 4 in that the capacitor C1 in the power recovery circuit is removed and one end of transistor LU and that of transistor LD are connected to the connection point of transistors QW and QW1 in the reset circuit. In other words, the transistors QW and QW1 in the reset circuit 15 are used as the switches PSW and QSW in FIG. 5 to realize the circuit.

During the sustain discharge period, QW is turned off, QW1 is turned on, and the voltage of the connection point of QW and QW1 is grounded. Then, in a state in which transistors QS and QY are turned off, Vs is applied to CU, and in a state in which CD is grounded, CU and CD, and LU and LD are turned alternately. A description about a reduction in power consumption, in this case, will be given later.

During the reset period, in a state in which the transistors CD, QS, QY, LU and LD are turned off and CU is turned on, QW1 in the reset circuit 15 is turned off and QW is turned on to raise the voltage of the connection point of QW and QW1 to Vw0. Due to this, a reset voltage Vw is generated at one end of a voltage-raising capacitor CS and is applied to CL via CU. At this time, as the voltage Vw0, which is larger than the ground level, is applied to one end of LD, the voltage to be applied across LD is smaller than Vw. Therefore, it is possible to specify the breakdown voltage of the transistor LD according to the sustain voltage Vs, which is smaller than the reset voltage Vw, and a structure composed of elements having a comparatively low breakdown voltage can be realized.

In the second embodiment, when the voltage to be supplied to the display capacitor CL is changed between +Vs and −Vs, it is temporarily changed to the ground level, which is the middle voltage, before changed to a target voltage, therefore, the amount of change in power is reduced and the effect can be achieved that power loss is reduced without using the inductance elements L1 and L2.

For example, if the power consumption when no power recovery circuit is provided is represented by P1, P1 is expressed as follows.

$$P1=CL\times Vs\times Vs/2$$

where CL represents the capacitance of the display capacitor.

Moreover, if the power consumption in the circuit in the second embodiment is represented by P2, P2 is expressed as follows.

$$P2=CL\times Vs\times Vs/4=P1/2$$

This means that the power consumption can be halved in principle without the inductance elements L1 and L2.

Although the embodiments in which the reset voltage is applied to the Y electrode are described above, the same effects can be achieved in the cases where the reset voltage is applied to the X electrode by applying the present invention to the X electrode drive circuit.

According to the plasma display apparatus of the present invention, even when a voltage larger than the sustain voltage is applied to the sustain electrode, elements having a comparatively low breakdown voltage can be used and the cost can be reduced because the voltage to be applied to the sustain transistors and the transistors in the power recovery circuit is smaller than the sustain voltage.

We claim:

1. A capacitive load drive circuit for supplying a first voltage and a second voltage alternately to a capacitive load, the capacitive load drive circuit comprising:

a switch, one end of which is connected to the capacitive load, wherein when a third voltage, whose voltage difference from the second voltage is larger than the voltage difference between the first voltage and the second voltage, is applied to the capacitive load, a fourth voltage is selectively applied to the other end of the switch.

2. The capacitive load drive circuit as set forth in claim 1, wherein when the first voltage and the second voltage are supplied alternately to the capacitive load, the second voltage is supplied to the other end of the switch.

3. The capacitive load drive circuit as set forth in claim 1, wherein when the first voltage and the second voltage are supplied alternately to the capacitive load, a voltage between the first voltage and second voltage is supplied to the other end of the switch.

4. The capacitive load drive circuit as set forth in claim 1, wherein the switch forms a resonance circuit together with the capacitive load and makes up a power recovery circuit for recovering energy when the voltage applied to the capacitive load changes and for consuming the recovered energy when the voltage applied to the capacitive load changes next time.

5. The capacitive load drive circuit as set forth in claim 3, wherein the switch is connected to the capacitive load via an inductance element.

6. The capacitive load drive circuit, as set forth in claim 4, wherein the switch is connected to the capacitive load via an inductance element.

7. A plasma display apparatus, comprising:

a display panel having first electrodes and second electrodes arranged adjacently by turns;

an X drive circuit driving the first electrode; and a Y drive circuit driving the second electrode, a first voltage and a second voltage are applied alternately to the first electrode and the second electrode to cause a sustain discharge to occur between the first electrode and the second electrode, to at least one of the first electrode and the second electrode, a third voltage whose voltage difference from the second voltage is larger than the voltage difference between the first voltage and the second voltage is applied, the X drive circuit or the Y drive circuit to be connected to the first electrode or the second electrode, to which the third voltage is applied, comprises a switch, one end of which is connected to the first electrode or the second electrode, and wherein when the third voltage is applied to the first electrode or the second electrode, a fourth voltage is selectively applied to the other end of the switch.

8. The plasma display apparatus as set forth in claim 7, wherein, when the first voltage and the second voltage are supplied alternately to the first electrode or the second electrode, the second voltage is supplied to the other end of the switch.

9. The plasma display apparatus as set forth in claim 7, when the first voltage and the second voltage are supplied alternately to the first electrode or the second electrode, a voltage between the first voltage and the second voltage is supplied to the other end of the switch.

10. A plasma display apparatus as set forth in claim 7, wherein:

at least one of the X drive circuit and the Y drive circuit has a resonance circuit formed together with the display capacitor of the display panel, a power recovery circuit recovering energy when the voltage applied to the one of the a power recovery circuit recovering energy when the voltage applied to the one of the first electrode and the second electrode changes and consuming the energy when the voltage applied to the one of the first electrode and the second electrode changes a next time is comprised, and the switch is a switch for making up the power recovery circuit.

11. The plasma display apparatus as set forth in claim 10, wherein the switch is connected to the one of the first electrode and the second electrode via an inductance element.

12. The plasma display apparatus, as set forth in claim 7, further comprising:

a first reset switch for supplying a reset voltage;

a second reset switch connected between the first reset switch and ground;

a voltage-raising capacitor connected to the connection point of the first reset switch and the second reset switch; and a reset voltage generation circuit generating the third voltage across the voltage-raising capacitor by turning the first reset switch into a conductive state and turning the second reset switch into a non-conductive state, while the first voltage is being charged to the voltage-raising capacitor by turning the first reset switch into a non-conductive state and turning the second reset switch into a conductive state, wherein the switch is connected to the connection point of the first reset switch and the second reset switch.

13. A drive circuit driving electrodes in a display panel having a pair of electrodes arranged adjacently by turns, the drive circuit comprising:

a first power source circuit supplying a first voltage to the electrodes;

a second power source circuit supplying a second voltage to the electrodes; and a power recovery circuit having an inductance element having a first end connected to the electrodes and a selection circuit selectively outputting a high voltage and a low voltage to a second opposite end of the inductance element.

14. The drive circuit, as set forth in claim 13, wherein the first power source circuit comprises a reset voltage generation circuit generating a third voltage larger than a first voltage.

15. The drive circuit as set forth in claim 13, wherein the selection circuit is connected to the second end of the inductance element via a capacitance element.

* * * * *

UNITED STATES PATENT AND TRADEMARK OFFICE

CERTIFICATE OF CORRECTION

PATENT NO. : 6,781,322 B2
DATED : August 24, 2004
INVENTOR(S) : Makoto Onozawa et al.

It is certified that error appears in the above-identified patent and that said Letters Patent is hereby corrected as shown below:

Column 8,
Line 67, after “wherein” insert -- , --

Column 9,
Line 4, after “wherein” insert -- , --
Line 50, after “7” insert -- wherein, --

Column 10,
Lines 1-2, delete in its entirety

Signed and Sealed this

First Day of February, 2005

JON W. DUDAS
*Director of the United States Patent and Trademark Office*